US006543948B2

(12) United States Patent
Beehler et al.

(10) Patent No.: US 6,543,948 B2
(45) Date of Patent: Apr. 8, 2003

(54) PRINTER WITH VACUUM PLATEN HAVING SELECTABLE ACTIVE AREA

(75) Inventors: James O Beehler, Brush Prairie, WA (US); Robert M. Yraceburu, Camas, WA (US); Steve O Rasmussen, Vancouver, WA (US); David E Smith, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/780,260

(22) Filed: Feb. 9, 2001

(65) Prior Publication Data

US 2002/0110400 A1 Aug. 15, 2002

(51) Int. Cl.[7] ..... B41J 13/08; B65H 5/02; B65H 5/22

(52) U.S. Cl. ..... 400/635; 271/276

(58) Field of Search ..... 271/276; 400/635, 400/634, 578

(56) References Cited

U.S. PATENT DOCUMENTS 3,527,166 A * 9/1970 Jaffa et al. ..... 101/126
3,584,954 A 6/1971 Nast
3,754,751 A * 8/1973 Capetti et al. ..... 271/103
4,378,155 A 3/1983 Nygaard
4,819,928 A * 4/1989 Osborn et al. ..... 271/193
5,414,491 A 5/1995 Bryant
5,717,446 A 2/1998 Teumer et al.
6,328,439 B1 12/2001 Rhodes
6,336,722 B1 1/2002 Wotton et al.

OTHER PUBLICATIONS

British Search Report dated Jun. 12, 2002.

* cited by examiner

*Primary Examiner*—Daniel J. Colilla

(57) ABSTRACT

A printer with a media transport has a rigid, air-transmissive platen. A movable air-transmissive flexible web overlies the platen and moves along a feed axis. A suction device communicates with the platen to draw air through the web and through the platen so that a sheet of media carried on the web is biased toward the platen. A manifold underlies the platen and has a number of separate chambers open to the platen, so that the suction device is connected to each of the chambers. A controller operates to selectably prevent communication between the suction device and at least some of the chambers.

51 Claims, 11 Drawing Sheets

PRINTER WITH VACUUM PLATEN HAVING SELECTABLE ACTIVE AREA

FIELD OF THE INVENTION

This invention relates to computer printers, and particularly to media transport mechanisms and vacuum hold-down devices.

BACKGROUND AND SUMMARY OF THE INVENTION

Some approaches for thermal inkjet printing use a vacuum platen as part of the media transport. Essentially, a sheet of media to be printed is carried on an air-transmissive belt over a flat plate that contains a multitude of apertures. A vacuum device below the plate draws air into the apertures, creating a pressure differential that flattens the media sheet against the plate, with the belt sliding over the plate to feed the sheet past a printing device. The printing device may be a thermal ink jet pen that reciprocates over the sheet in a scan direction perpendicular to the feed direction, and which lays down successive swaths of ink droplets to generate a printed image.

The platen may be heated to facilitate rapid drying of aqueous ink, and the vacuum effect holds the sheet in a flat stable position as the ink dries. This avoids curling or "cockle" effects that can distort the media surface in areas where large quantities of ink are imprinted, due to the dimensional effect of moisture on paper and other media. When the media is held flat during the drying process, a flat result is generated.

While effective for many applications, vacuum platens have certain limitations. First, smaller media that does not cover most of the platen area leave substantial platen areas open. This permits air to be drawn into the area below the platen, bypassing the sheet, and thereby requiring substantial airflow capacity to maintain adequate relative pressure on the sheet. For a minimally sized sheet, nearly the entire area of the platen may be open to airflow. This requires a large vacuum blower, with attendant problems of size, power consumption, and noise. Further, for the platen to be maintained at an elevated temperature needed for ink drying, increased heating power is needed to offset the cooling effect of ambient air flowing through the platen. Also, open areas surrounding a small media sheet may still have depressed temperatures compared to covered regions, and subsequent large media may encounter non-uniform platen temperatures that may impair printing results. In addition, temperature gradients may occur near media edges, leading to non-uniform drying.

An additional concern even for platens optimized for a particular media width is that unless a continuous end-to-end stream of media is passed over the platen, there will be large open areas of the platen ahead of the leading edge of the first sheet, and following the training edge of the last sheet. This generates similar disadvantages to those discussed above regarding media width.

The present invention overcomes the limitations of the prior art by providing a printer with a media transport having a rigid, air-transmissive platen. A movable air-transmissive flexible web overlies the platen and moves along a feed axis. A suction device communicates with the platen to draw air through the web and through the platen so that a sheet of media carried on the web is biased toward the platen. A manifold underlies the platen and has a number of separate chambers open to the platen, so that the suction device is connected to each of the chambers. A controller operates to selectably prevent communication between the suction device and at least some of the chambers.

DETAILED DESCRIPTION OF PREFERRED AND ALTERNATIVE EMBODIMENTS

Figure 1:
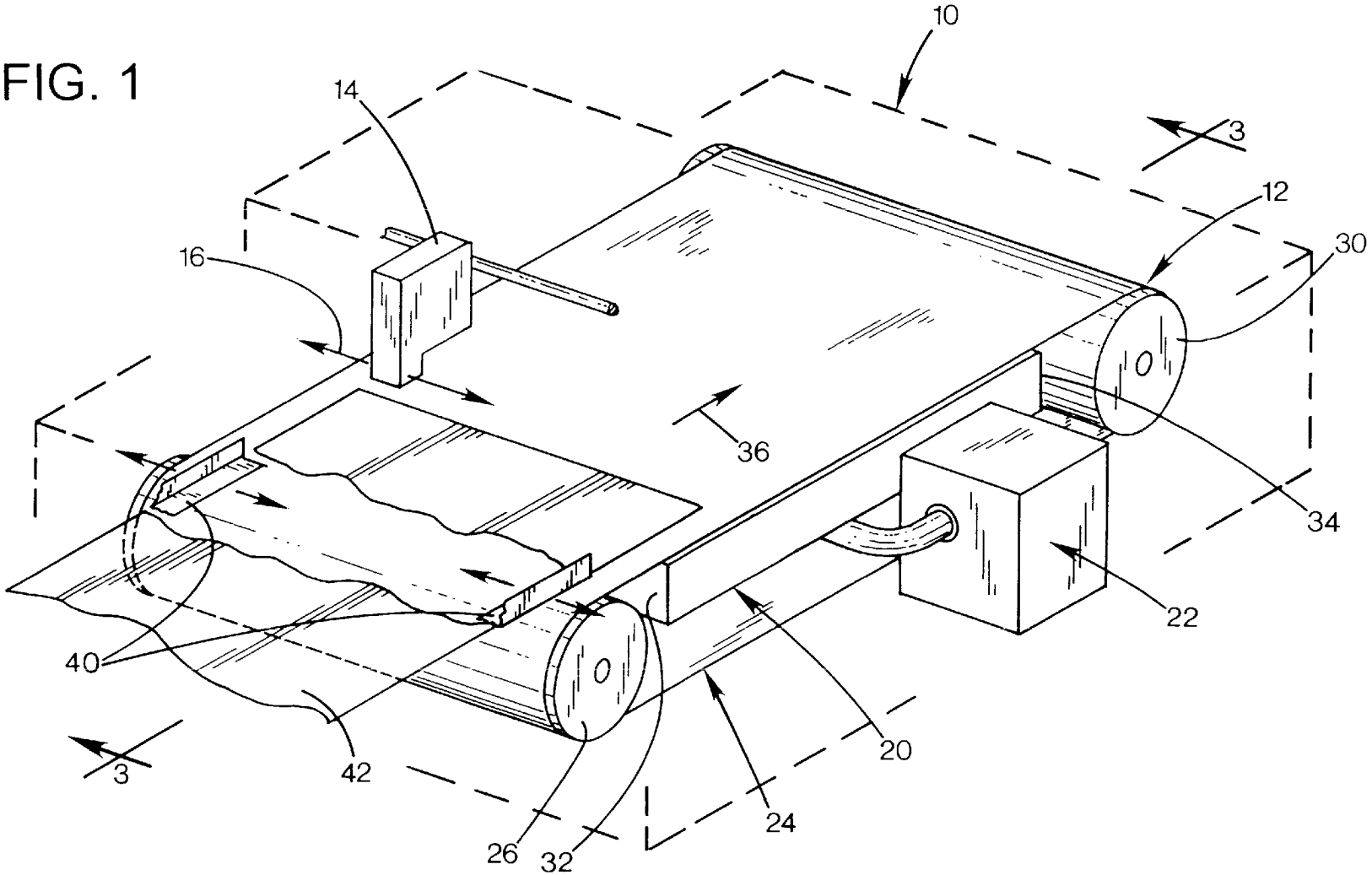
FIG. 1 is a perspective view of a printer and media transport mechanism according to a first embodiment of the invention.

FIG. 1 shows an ink jet printer 10 having a media transport mechanism 12 over which an ink jet pen 14 reciprocates along a scan axis 16. The transport mechanism includes a platen assembly 20 having a flat upper surface. A vacuum blower 22 is connected to the platen device to draw air through perforations in the upper surface of the platen as will be discussed below. The blower may be specified as a centrifugal blower capable of 10-inch water column and a flow rate depending on platen size. A media transport belt 24 encompasses the platen, and is tautly supported by opposed belt rollers 26, 30, one at an inlet edge 32 of the platen, and one at an outlet edge 34 of the platen. The uppermost surfaces of the rollers occupy a common plane with the upper surface of the platen assembly, so that the upper web of the belt rests at the platen's upper surface.

The belt is an air-transmissive mesh screen, or may be any perforated or porous sheet having a low air flow resistance, small thickness, and flexibility. The outlet end roller 30 is motorized to drive the belt in a feed direction 36, which defines the feed axis perpendicular to the scan axis 16. The movement of the belt is controlled by control circuitry (not shown) that also controls the pen scanning, ink droplet expulsion, and all other operations of the printer to provide coordinated action. A pair of paper guides 40 upstream of the inlet end of the media transport adjust in concert to the width of a media sheet 42, centering the sheet within a media supply tray (not shown) on a midline of the platen parallel to the feed axis, and preventing skewing of the sheet. The guides may include sensors that feed back the guide positions to the controller so that the controller may establish other printer functions based on the inferred media width.

Figure 2:
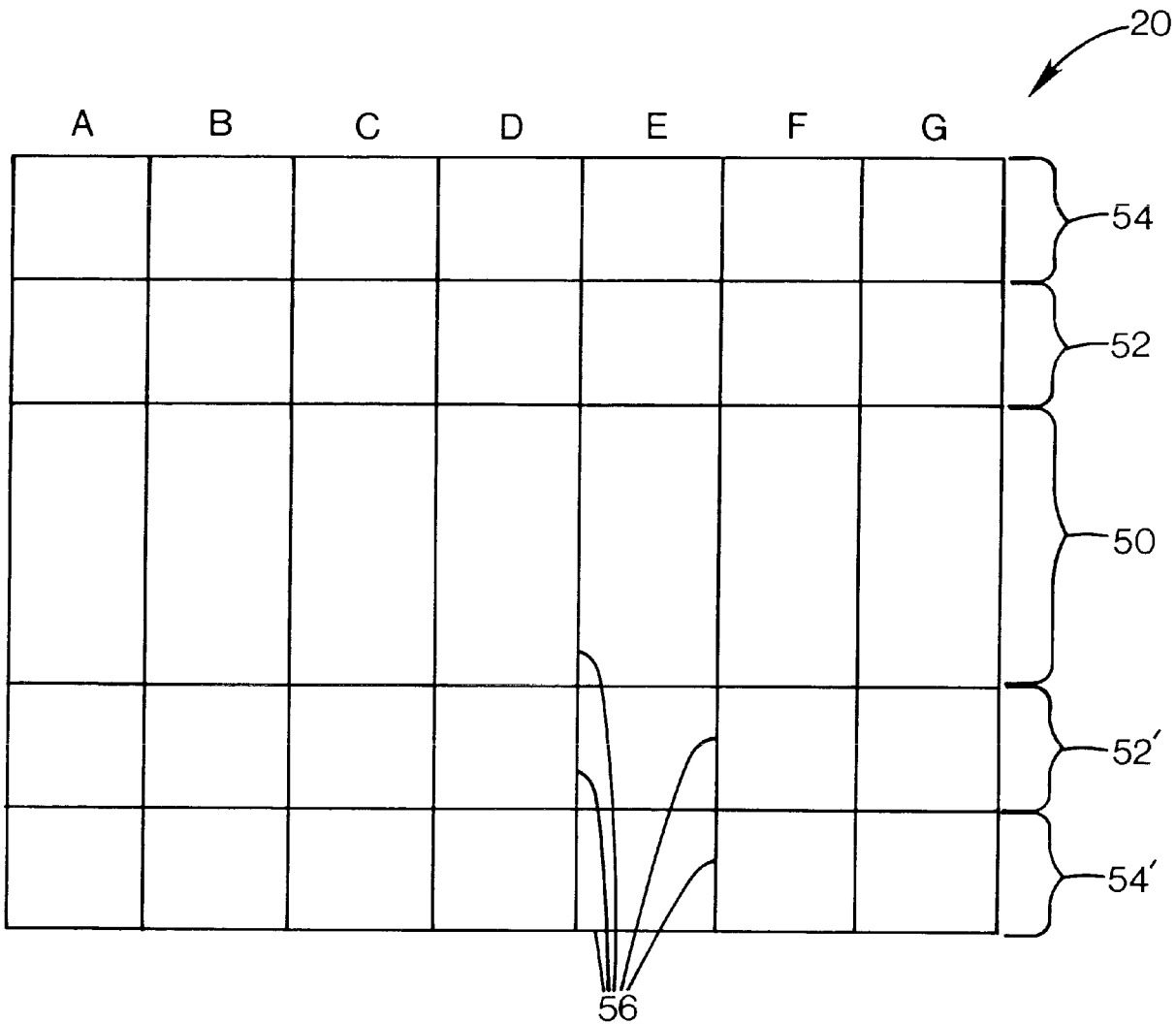
FIG. 2 is a schematic plan view of the platen of the embodiment of FIG. 1.

FIG. 2 shows a schematic plan view of the platen 20, which is divided into rows 50, 52, 52', 54, 54' and columns A–G. In the illustrated embodiment, the rows and columns define a matrix of sectors 56, each of which may be identified by its row and column (e.g. 54A, 52'F.) As will be discussed below, each sector may be switched from a closed condition in which air does not flow through the sector, to an open condition in which air is transmitted. This allows the open area beyond the periphery of a smaller sheet to be limited, reducing the needed capacity of a vacuum blower due to the limited amount of air bypassing the sheet. The sectors are switched between conditions by any of several preferred and alternative embodiment mechanisms discussed below. To provide transport of typical rectangular sheets, each sector need not be independently switched, but may be switched by mechanisms that operate entire columns and rows in manners to be discussed below.

Generally, all sectors are initially closed prior to a sheet being fed across the platen. The media guide width sensor communicates an inferred media width to control circuitry, to determine which sectors are entirely beyond the peripheral lateral edges of the sheet, and thus may be switched to a closed position. The media guide serves to center a sheet on a mid-line of the platen. For sheet widths that do not correspond precisely to a boundary between rows, a row on each edge will be partly covered by the sheet, and partly open. This open area is thus limited to less than or equal to the area of two rows, regardless of sheet size. A margin of extra open area greater than that which might nominally be required may be added to allow a tolerance for skew or other misalignment of a sheet.

For example, a sheet with a width slightly greater than row 50 (which is wider than the other rows to simplify the device, and in view of the presumption that very narrow sheets will rarely be required) will slightly overlap rows 52, 52', and will not reach rows 54, 54'. Thus, rows 50, 52, 52' are set to the open position to provide a vacuum over the entire sheet, and rows 54, 54' are closed. In alternative embodiments, the number of rows (and/or columns) may be varied to accommodate any range of paper widths. Moreover, the width of rows (and/or columns) may be narrowed, and the population increased, to provide a finer width control of the open active area, to minimize the amount of vacuum bypass where vacuum facility capabilities are limited. The center row may be narrowed to accommodate all paper widths with no lower limit. The peripheral rows 52, 52', 54, 54' need not be of uniform width, but may be set to accommodate standard paper widths.

Further, the rows need not be configured symmetrically about the midline (as for the centered media system of the preferred embodiment) but may be arranged to accommodate an edge-registered media transport in which different media widths are handled by adjusting the boundary between closed and open rows on one side only.

To reduce the air flow bypassing the leading or trailing edges of the sheet, the columns are switched open in advance of the leading edge, and closed after the trailing edge passes. A column (at least the sectors corresponding to the active width as noted above) is opened or made active just prior to arrival of the leading edge to any portion of the column, and closed just after departure of the leading edge from any portion of the column. This ensures that the entire area overlaid by the sheet is open and active at all times. Media edge sensors are provided to detect the position of the leading edge, so that the position of the leading edge may be tracked based on how far the sheet has been fed since triggering the sensor. The motion and position of a belt roller or other element linked to the feed mechanism progress provides the means for tracking sheet advancement.

For printing multiple sheets in a single job, the sheets may be fed with the leading edge of each subsequent sheet following near the trailing edge of prior sheet, so that columns need not be disabled between sheets. For transitions between media of greatly different widths, a gap between sheets may be required (at least in the illustrated embodiment.) This allows a sheet of one width to be fully transported off the platen before a different-width sheet is received, and avoids a circumstance in which either the wider sheet is not fully underlain by active vacuum areas, or in which the smaller sheet is adjoined by excessively wide open areas with excessive vacuum bypass flow.

Figure 3:
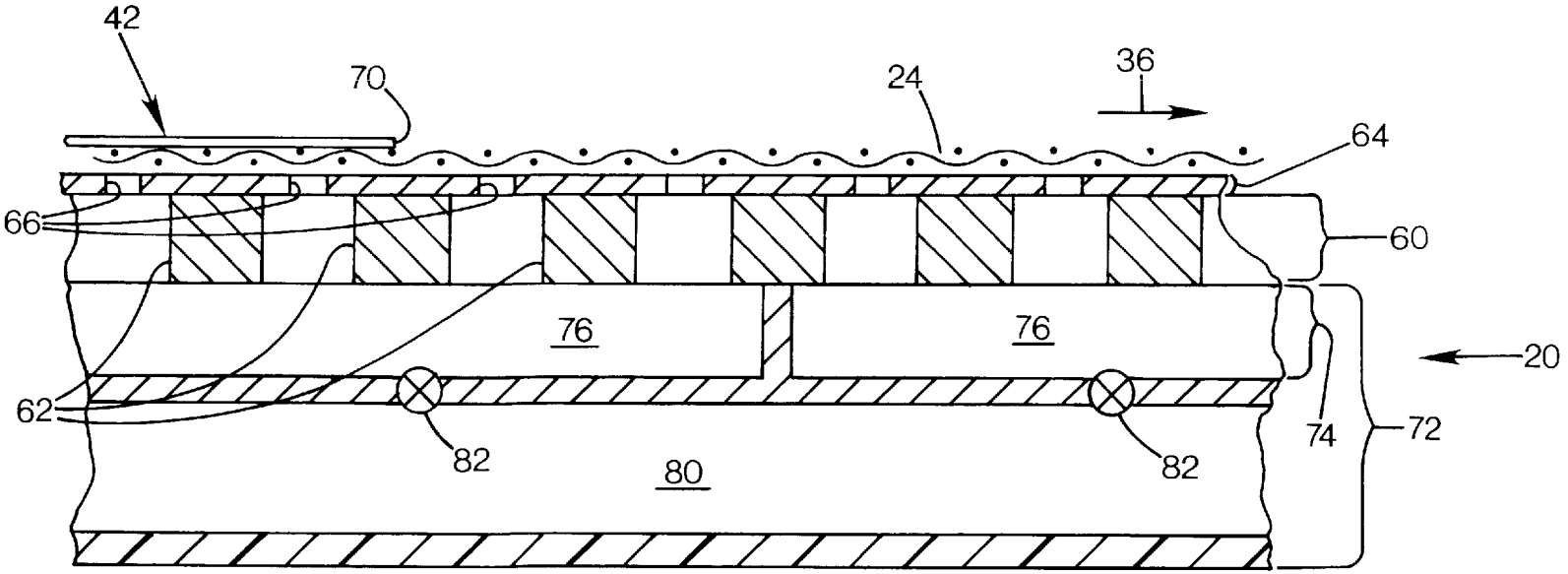
FIG. 3 is an enlarged sectional view of the platen of the embodiment of FIG. 1.

FIG. 3 shows an enlarged sectional view of the platen assembly 20. A rigid plate 60 provides structure for the platen surface, and is perforated with a multitude of holes 62. The plate thickness is preferably about 12 mm, the hole diameter about 3 mm, and the hole center-to-center spacing about 6 mm in each direction, although these may vary widely in different applications.

An airflow limiting sheet 64 overlays the upper surface of the plate, and defines a multitude of apertures 66, each registered with and centered on a respective plate hole 62. The apertures have a limited diameter less than that of the plate holes 62, so that the pressure drop during air flow is greatest across the apertures. The apertures are sized in conjunction with the capacity of the blower to generate a required flow rate at a pressure differential of at least a 10 inch water column between the plenum and ambient to ensure the media sheet is secured adequately against the platen. The pressure differential may vary depending on the particular application. In the illustrated embodiment, the sheet thickness is preferably about 0.25 mm, and the aperture diameter about 0.6 mm, although these may vary widely in different applications. The belt 24 overlays the sheet 64, and moves in the feed direction 36. The belt rests on the sheet without a gap, and with minimal force, except as generated by vacuum forces on the media sheet. As shown, the media sheet 42 rests on the belt and has a leading edge 70 that advances in the feed direction.

Below the plate is a flow control box 72 illustrated in a simplified schematic manner for clarity; detailed illustrations of preferred and alternative embodiments are discussed below. The box has an upper level 74 defining separate sector chambers 76, each below a selected sector of the plate and laterally isolated from the other chambers. A plenum 80 underlies all the chambers, and is connected to each by a valve 82 (shown symbolically.) The plenum is connected to the vacuum blower 22. Each valve has an open position and a closed position, so that air flows (or suction is generated on the sheet 42) when open, and no air flows when closed.

By maintaining the valves in the open position underneath all portions of the sheet, the entire sheet is flattened against the platen. Some marginal open sector portions beyond the sheet edges on all sides are tolerated, with the blower having adequate capacity to maintain the needed partial vacuum in the plenum even when these areas are open. With a blower rated at 40 cubic feet per minute, an open area of 70 square inches is tolerated while maintaining the needed pressure differential. This is significantly less than the typical area of the entire platen, necessitating the closing of many or most of the valves where the platen is not covered by the media sheet, to allow the use of a practical and economical use of a limited capacity blower, with attendant advantages in size, power consumption, and quietness.

Figure 4:
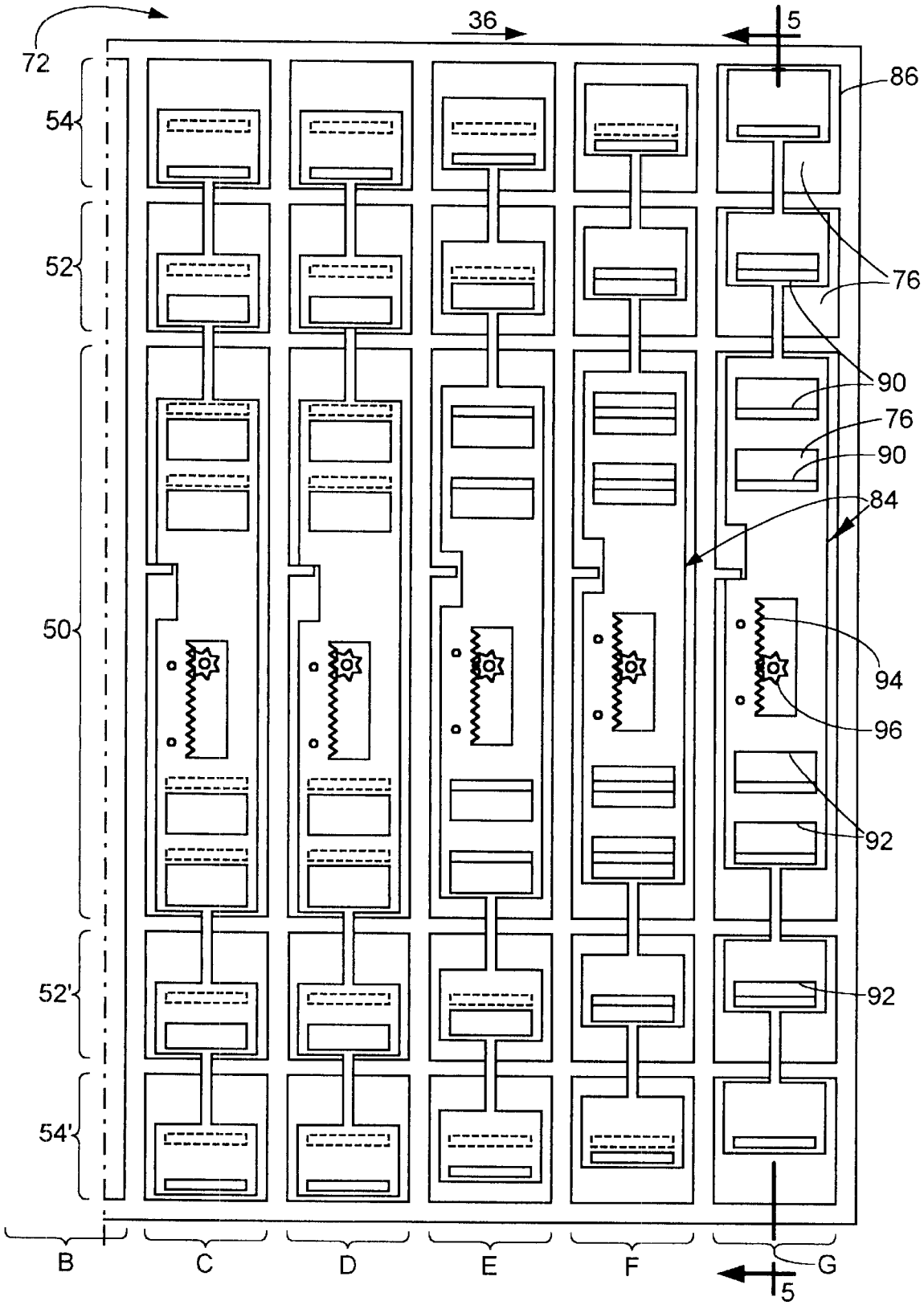
FIG. 4 is a plan view of the valve mechanism of the embodiment of FIG. 1.
Figure 5:
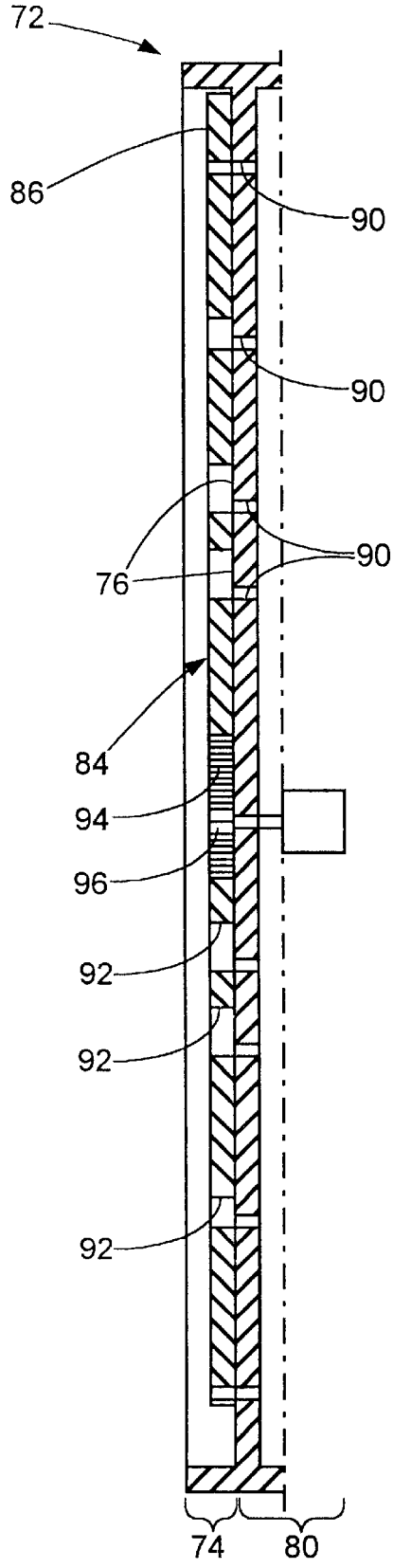
FIG. 5 is a sectional side view of the valve mechanism of the embodiment of FIG. 1.

FIGS. 4 and 5 show a first embodiment of the flow control box 72. Each column of chambers is occupied by an elongated flat shutter element 84 having a rectangular lobe 86 occupying each chamber 76. Each chamber has a floor defining a slot 90 extending parallel to the feed direction, nearly the width of the chamber. Each lobe of each shutter defines at least one corresponding aperture 92 having a similar length to that of the chamber slot, and at least as great a width. Each lobe also includes a solid portion large enough to entirely obscure the chamber slot when aligned with the slot. The shutter slots of the outer rows 54, 54' are the narrowest, little larger than the chamber slot width. The shutter slots of the next rows 52, 52' are wider, allowing the slots to align for air flow over a wider range of shutter positions. The slots of the center row 50 are wider still, allowing air flow alignment over a still wider range of positions. The lobes of the shutters are connected by narrow extensions that pass closely through openings defined in the low walls that separate the chambers. Gaskets may be provided at these openings to minimize any air flow through the openings.

Each shutter is movable in a direction along its length through a range of positions. A rack 94 is provided on the shutter, and a pinion 96 attached to a motor or suitable actuator is connected to the box, so that rotation of the pinion operates to set the position of the shutter. The shutters are shown in each of the pertinent range of positions. The column G shutter is shown in a fully open position in which all chamber slots are aligned with shutter slots to permit airflow; the shutter is at the upper limit of its travel, in the frame of reference of the illustration. The column F shutter is shifted slightly downward to a first intermediate position in which the narrow shutter slots in the outermost rows 54, 54' are offset from the corresponding chamber slots, while the other sectors are open due to their wider shutter slots tolerating the shift. The column E shutter is shifted further downward so that only the central row chamber slot remains open. In column D, the shutter is shifted downward to a fully closed position at the limit of its travel, in which all chambers are closed, by lobe portions of the shutter which extend sufficiently beyond the shutter slots to cover each aperture.

The shutter valve system is shown in each of the various shutter positions for illustration only. Normally, all shutters will be in the closed position (as column D). Then, just before the leading edge of a sheet approaches each column, the shutter for that column is quickly shifted to a position corresponding to the width of the sheet. After the trailing edge of the sheet departs each column (assuming there is not another sheet immediately following,) the corresponding shutter moves to close all apertures. The system may employ any number of columns and rows, with the shutter slot width progressively increasing for the rows toward the center. The shifting mechanism may be of any type, including sequencing mechanisms such as will be discussed below. The concept may further be embodied with shutter slots of a common, narrow width, and chamber slots of different widths to control which are opened based on the degree of shift.

Figure 6:
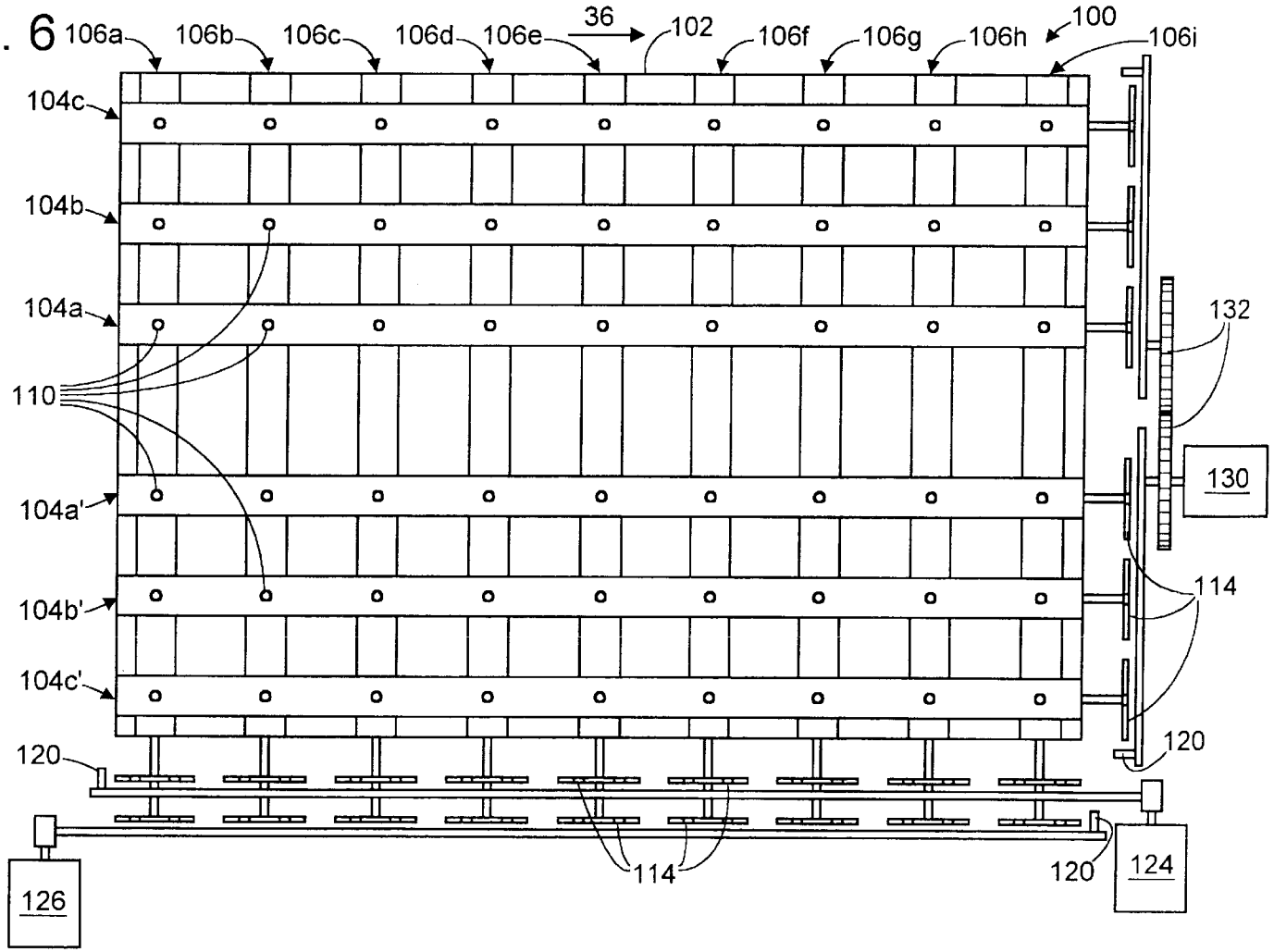
FIG. 6 is a plan view of the valve mechanism of an alternative embodiment of the invention.
Figure 7:
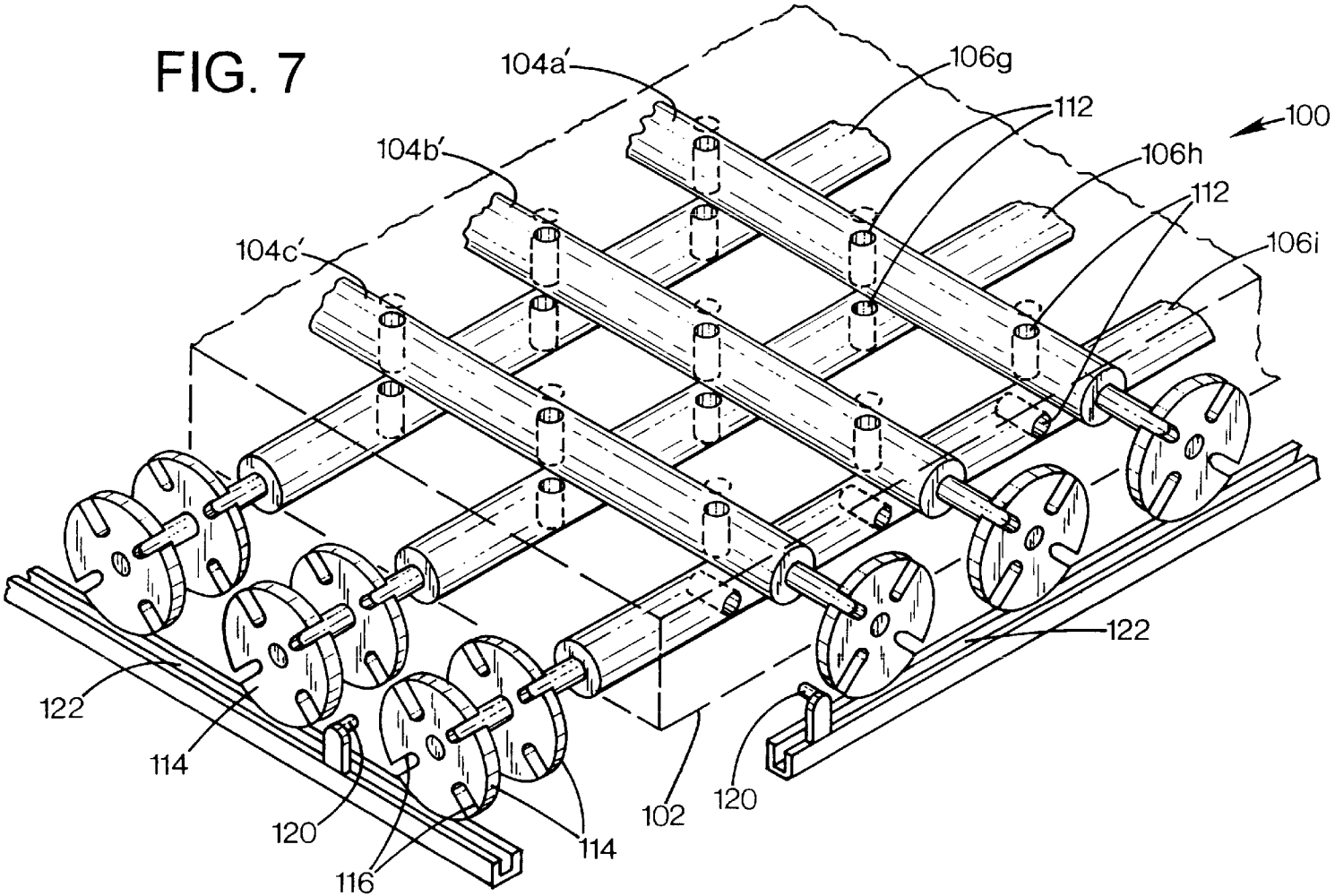
FIG. 7 is a perspective view of the valve mechanism of the embodiment of FIG. 6.

An alternative valve facility 100 is shown in FIGS. 6 and 7. The facility is essentially the panel separating the sector chambers 76 on the upper side, from the plenum 80 below. The facility includes a block 102 coextensive with the platen. The block defines a first array of upper bores in a common plane near the upper surface to closely accommodate a set of shafts 104*a*, 104*a'*, 104*b*, 104*b'*, 104*c*, 104*c'*. The shafts 104 extend within the full length of the block parallel to the feed axis 36, and rotate within the block. Each shaft 104 (or group of shafts) corresponds to a given row on the platen (as shown in FIG. 2.) The block defines a second array of bores in a common plane near the lower surface, just below the upper bores to closely accommodate a set of shafts 106*a*, 106*b*, 106*c*, . . . 106*i*. The shafts 104 extend within the full width of the block perpendicular to the feed axis 36, and rotate within the block.

The block defines a plurality of small through holes 110 passing entirely through the block perpendicular to its major faces. Each through hole is positioned at an intersection of a shaft 104 and a shaft 106, and has a diameter less than the shaft diameters. Each shaft has a similar through hole 112 at each intersection location to register co-linearly with the block hole when the shaft is rotated to an open position in which the holes 112 are vertical (perpendicular to the plane of the block.) The holes 112 of each shaft are parallel to each other such that all are registered with the block holes when the shaft is in the open position. At a given intersection of shafts, when both shafts are in the open position, the holes align, and air flow is permitted in the associated sector chamber. If either shaft associated with an intersection is rotated away from the open position, no air will flow through the sector. FIG. 7 shows an example in which shafts 104*a'*, *b'*, *c'* are all open, shafts 106*g* and *h* are open, and shaft 106*i* is rotated 90° to a closed position.

The shaft positions may be controlled by any mechanical or electrical means. In the illustrated example, the shafts are controlled by sequencer mechanisms requiring a minimum of electrical transducers and control inputs. Each shaft is connected to a round cam 114 having four radial slots 116 at equal 90° intervals. An actuator pin 120 operates a cam by moving along a path 122 perpendicular to the axes of the shafts it is to actuate, and parallel to the planes of the associated cams. As the pin encounters a cam, it enters a slot, and rotates the cam by 90° as it passes, exiting the slot and moving along, leaving the slot ends ready for receiving a pin from either direction. The passage of a pin in either direction shifts the position of the associated shaft from open to closed, or from closed to open.

Because the shafts need not be independently controllable, a single pin proceeding along the cams of shafts 106 can serve to open each column in sequence (in advance of the leading edge of a sheet), and to close each in sequence (following the trailing edge.) FIG. 6 shows schematically a leading edge control motor 124 connected to a pin 120 for opening the columns sequentially. A separate trailing edge control motor 126 controls a separate pin on a separate track, so that a small media sheet such as a card may be printed with closed columns ahead of the leading edge, and columns behind the trailing edge closed as the sheet is fed.

Means may be provided to retract the pins to return each to the inlet end of the platen when a traverse is complete, without actuating the cams in the process. Alternatively, a pause may occur in such circumstances for the two pins to rapidly return, spaced apart by at least one column width, so that the columns are all in the closed position when the return traverse is complete, just as the columns are all closed following the exit of a sheet from the platen.

The control of the shafts 104 associated with the rows does not require sequencing, but simply must shift the rows to the desired condition: either all closed (which is not necessary as the column shafts may provide this condition), all open (for a full width sheet), or a centered row or group of rows open, and the peripheral rows on each side closed (for a smaller sized sheet.) Because in the illustrated embodiment the sheet is centered on the platen, the row controls operate symmetrically. Thus, a single row control motor 130 may operate two actuator pins 120 via a geared mechanism 132 that translates motor rotation to translation of the pins in opposed directions.

Figure 8:
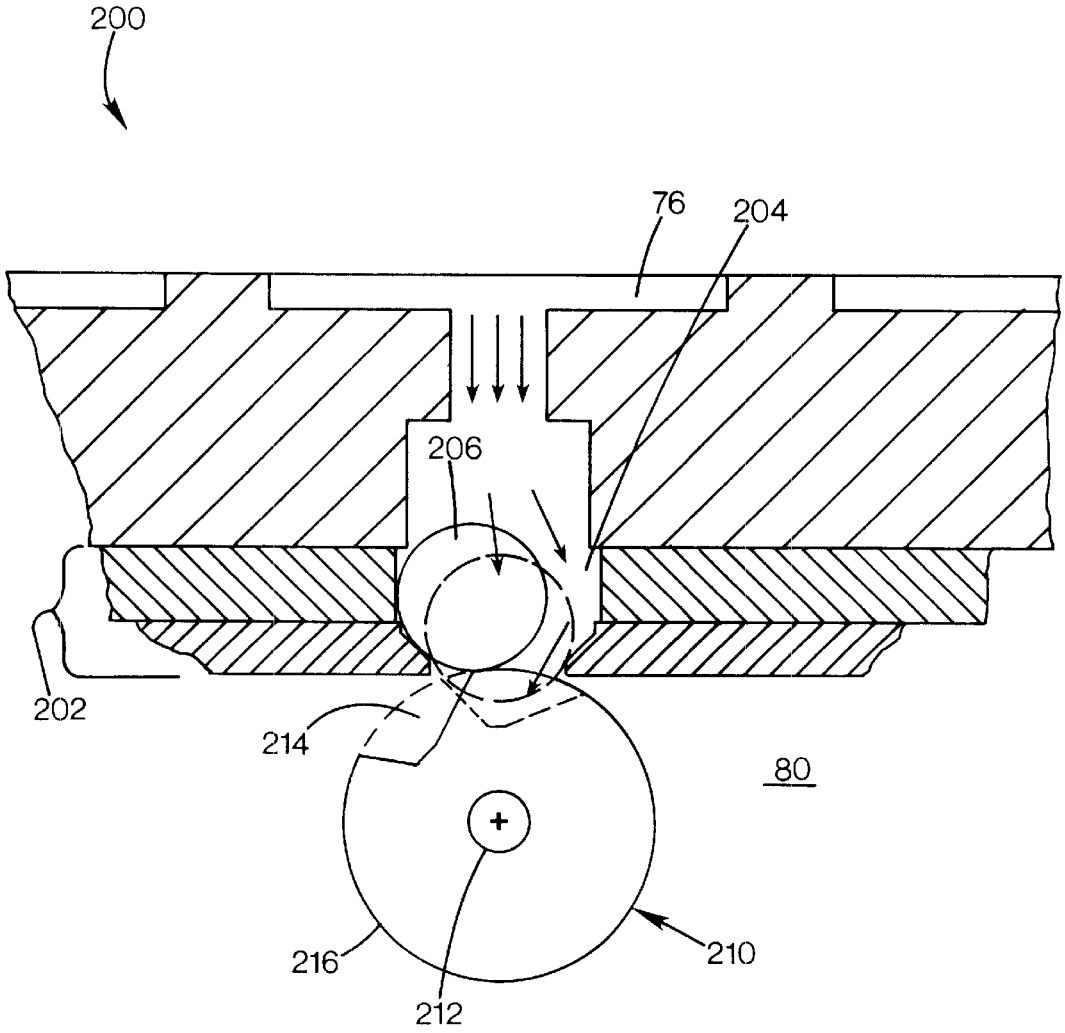
FIG. 8 is a sectional side view of the valve mechanism of a further alternative embodiment of the invention.
Figure 9:
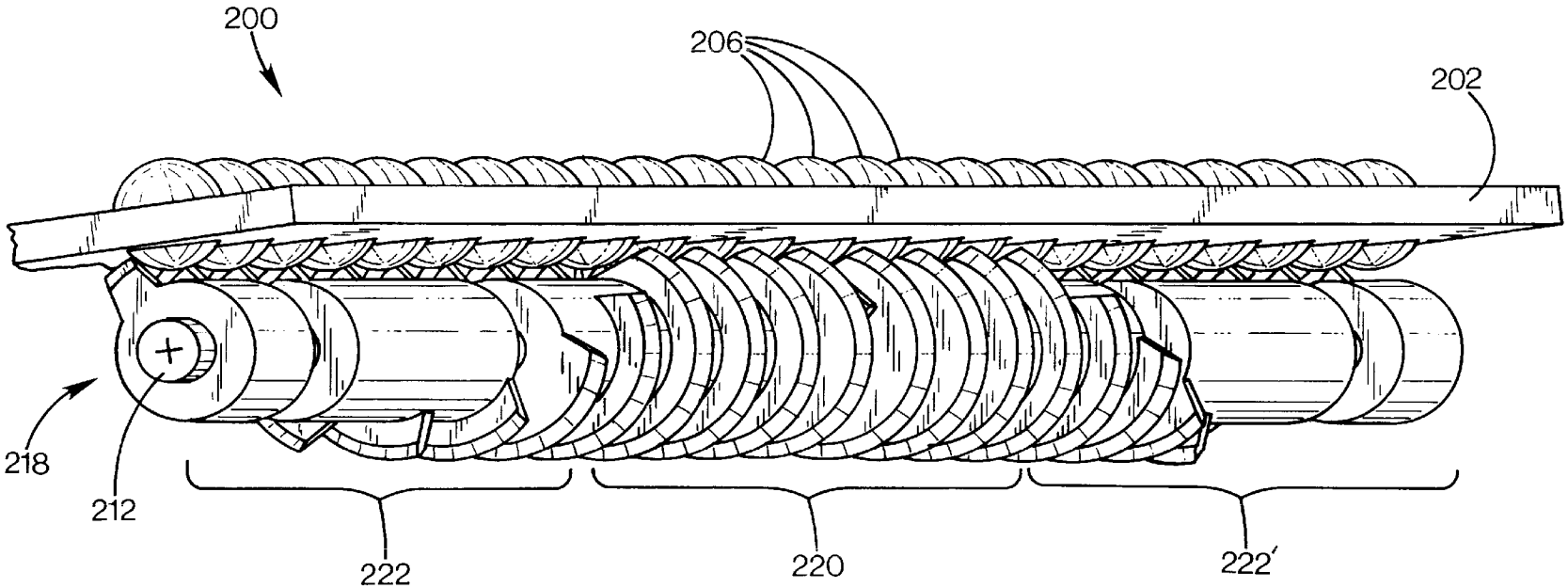
FIG. 9 is a perspective view of the valve mechanism of the embodiment of FIG. 8.

Another alternative valve facility 200 for operation beneath the platen to control airflow through the sectors of the platen is shown in FIGS. 8 and 9. As shown in FIG. 8, the facility includes a plate 202 residing beneath the chambers 76. The plate defines a plurality of compartments 204, with a ball 206 residing in each compartment. The lower aperture of each compartment is smaller than the ball diameter, so that the ball does not fall downward from the compartment. The lower aperture is round, so that the ball forms a seal against it to prevent downward air flow when the ball is in the sealed position shown in dashed lines. The aperture is chamfered so that the ball is supported by the lower rim of the aperture to protrude downward below the lower surface of the plate 202.

The ball 206 is movable to the open position shown in solid lines by operation of a planar cam 210 connected to a shaft 212. The cam has an open sector 214 having a reduced radius that allows the ball to lower to the sealed position when the open sector is aligned below the aperture of the compartment 204. The remainder of the cam has a circular peripheral portion 216 away from the open portion. This peripheral poriton has a radius adequate to displace the ball upward to an open position, and to slightly protrude above the plane of the lower surface of the plate 202 to push the ball upward as high as possible to provide a low restriction air flow path. The periphery is kept spaced apart from the plate edges of the aperture to prevent friction and noise. The cam is a flat plate having a thickness significantly less than the aperture diameter so that the cam itself does not appreciably block air flow.

FIG. 9 shows a section of the valve assembly corresponding to one column of the platen; the complete assembly includes multiple sections, one for each column. The section includes the plate portion 202 supporting a row of balls 206, with a camshaft assembly 218 below the balls. The camshaft assembly includes the shaft 212, and a number of cams, each associated with a ball 206. The assembly is illustrated as an embodiment with a finer degree of width control than required for the five-row example discussed above, having a much greater number of narrower rows. A central section 220 of cams and balls employs cams with a common profile, in the shape illustrated in FIG. 8. These have the narrowest open portion 214, so that the balls are displaced and the valves opened in response to a minimal counterclockwise rotation of the shaft, with the valves opening simultaneously in this section 220. This corresponds to the narrowest practical media width to be used (or to an area of tolerable bypass air flow for narrower media.)

Outboard sections 222 and 222' are symmetrical to each other. Within each outboard section, the cams are each different from their adjacent neighbors. Progressing from the cam nearest the center section 220, the cams of the outboard sections have progressively larger open sections, and smaller peripheral portions. This provides for the length of the set of open valves to be dependent on the amount by which the camshaft is rotated in the counterclockwise direction. The shaft rotates from the fully closed position shown, in a counterclockwise direction by nearly a full rotation to a position in which even the peripheries of the endmost cams actuate the associated balls, as do all other cams. In intermediate rotational positions, a contiguous, centered set of balls will be opened, with the width of the set dependent on the degree of rotation.

The cam shaft embodiment operates by initially setting each shaft in the fully closed position. A determination is made of the width of media to be transmitted over the platen. As the leading edge of the media approaches each column, the associated shaft quickly is rotated to a position that opens a swath of balls just wide enough to ensure that the sheet overlays open chambers. After the sheet's trailing edge passes, the shaft rotates back to the fully closed position.

Figure 10:
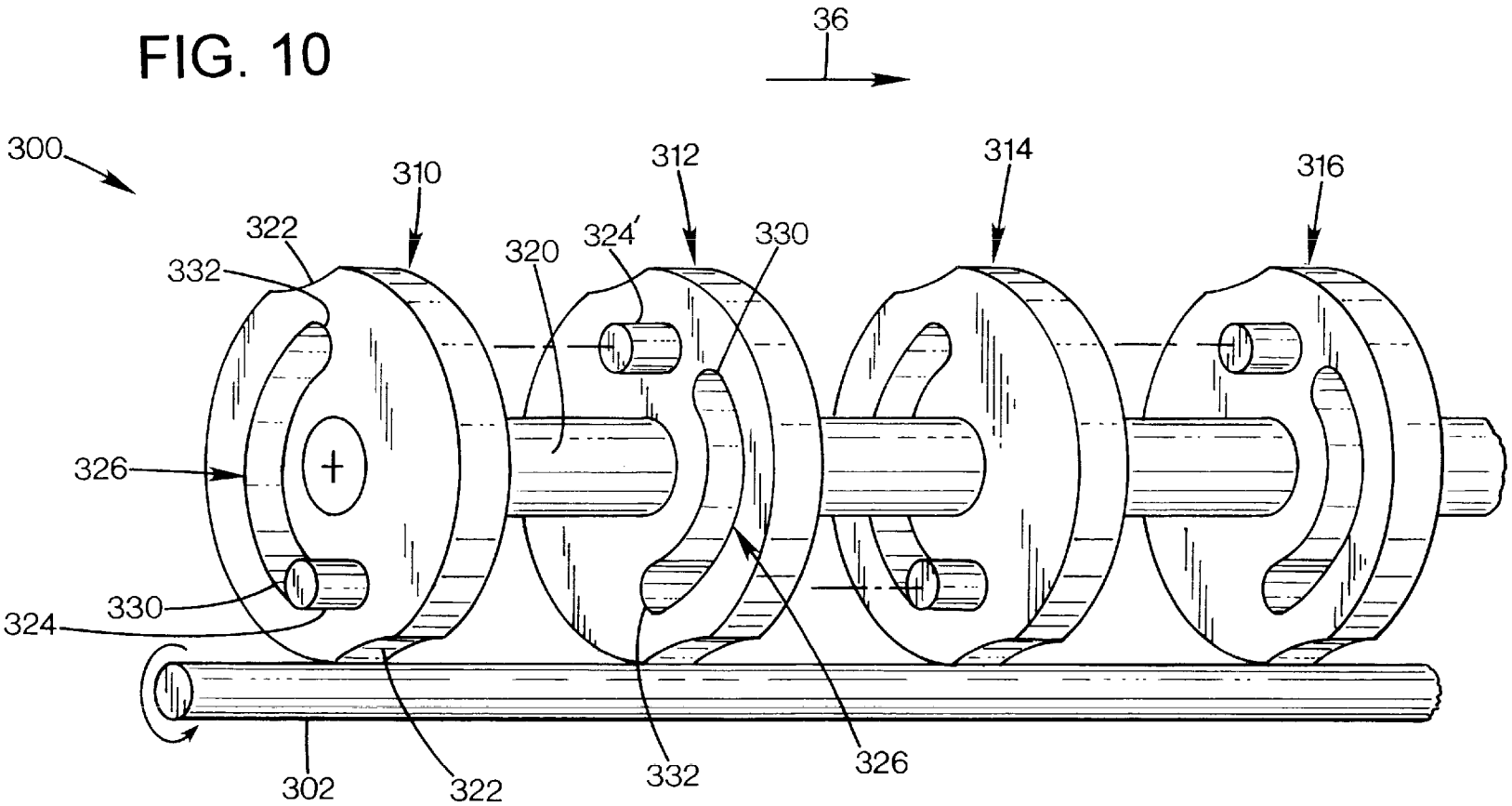
FIG. 10 is a perspective view of a further alternative embodiment of the invention.

FIG. 10 shows an exploded view of a sequencing mechanism 300 usable with any of several of the above valve facilities. The mechanism includes a drive shaft 302 that rotates with a velocity proportionate to the velocity of the media sheet feed belt 24. Preferably, a common motor drives both, for simplicity. A mechanical linkage connecting the two elements may allow one to be driven by the other, or they may be driven by a common motor. Alternatively, each may be controlled by an separate motor, and the motors synchronized by connection to a common controller.

The mechanism includes a sequence of disks 310, 312, 314, 316, each associated with a column of platen chambers. Although illustrated as including four disks for simplicity, the illustrated embodiment will generally have more discs. The disks are each journaled for rotation on a shaft 320 that runs parallel to the feed direction 36 and to the drive shaft 302. Each disk has a circular periphery interrupted by opposed divots 322. The shafts are spaced apart so that the periphery of each disk makes engaged rolling contact with the surface of the drive shaft 302, except at the divots. Thus, rotation of the drive shaft will cause rotation of any disks having the periphery currently in contact. Such rotation of any such disk will continue until a divot reaches the drive shaft. Upon this, the disk will not further rotate as the drive shaft continues to rotate, unless the disk is rotated further by an external impulse of additional rotation to bring the next uninterrupted periphery segment of the disk into contact with the shaft for rotation with the shaft until the other divot is reached. Accordingly, with the two divots opposed by 180 degrees, each disk rotates one half rotation each time a sufficient impulse is imparted, and remains stable in either of the two positions with divot adjacent the shaft, even while the shaft continues to rotate.

Each disk is connected to a column valve element to control the state of the valves of the column. The element may be any of the examples discussed above, at least inasmuch as the column element operates between a closed state and an open state. Each disk and the associated column valve element are interconnected by suitable mechanisms to provide that the valve element is open when the disk is in one stable state, and closed when the disc is in the other stable state. The interconnection may be by means of a linkage that converts the disk's rotation to the translation of a shutter, or by gearing to convert to the rotation on a different axis such as for the shaft valves of FIGS. 6 and 7.

The disks are interconnected to each other in a manner that provides that each disk provides the impulse to the next disk as it is changing states, so that a state change is passed along the line sequentially in response to a state change in the first disk. By coordinating the drive shaft rotation with the sheet feed rate, the state change of the discs propagates down the sequence of disks at the same rate as the sheet feed rate. This permits each of the valve columns to open just prior to arrival of the leading edge of a sheet, and to close following the trailing edge, based only upon a single impulse on the first disk to indicate the leading edge location, and upon a second impulse to indicate the training edge location. Such initial impulse may be made in response to an optical or other edge detector. Even if the sheet feed does not proceed at a smooth or constant rate (as may occur in some printing systems that may employ the sequencer and platen vacuum valve mechanisms), the column valve timing is coordinated with the sheet position. This avoids the need for multiple sensors along the platen, and for multiple separately controllable actuators, one for each column.

Each disk includes a pin 324 protruding from one major face of the disk facing the inlet direction (opposite the feed direction.) An arcuate slot 326 passes through the disk to both faces, has a width sized to slidably receive a pin on an adjacent disk, and extends from a first end 330 near the pin, to a far end 332 having a radiused end with a center point 180 degrees opposed to the center of the pin 330. Although shown spaced apart for clarity, the disks are spaced on the spacing of the columns, and may be stacked face-to face, with only minimal clearance needed to avoid friction. The pin 324 of each disc other than the first disk 310 is received in the slot 326 of the adjacent disk in the inlet direction. In the condition shown, all disks are in a stable condition, with a divot 322 at the drive shaft 302, which is rotating in a counter clockwise direction. Necessarily, the identical disks are in alternating orientations, with the pin of each resting in the slot end 332 of the adjacent disk.

In operation, an edge sensor detects the leading edge of a sheet of media as the belt and drive shaft move in concert. In response to the edge detection, an actuator such as a solenoid provides an impulse to rotate the first disk 310 in the clockwise direction by at least enough for the lower edge of the near periphery of the disk to engage the rotating drive shaft. Upon such contact, the disk 310 is driven by the drive shaft to continue rotating. Before the rotation brings the opposite divot to the drive shaft, the slot end 330 engages the pin 324' of the next disk 312, causing it to rotate along with the first disk. The slot end 330 center and the center of the pin 324 of each disk are separated by an adequate angle greater than the angle subtended by each divot. This ensures that the periphery of the second disk is brought into engagement with the drive shaft before the second divot of the first disk reaches the shaft, ending rotation of the first disk. After the first disk reaches the stable position, the rotation of the second continues without disturbing the first, because the pin 324' of the second moves freely in the slot 326 of the first, from one end 330 to the other end 332.

The rotation of the second disk proceeds for one half turn, actuating rotation of the third disk before a half turn leaves the second disk in a stable position. The third actuates the fourth, and so on, until all disks are in the opposite state from that in which they started, and the valve columns of the platen are all in the open position. As the trailing edge of the sheet is detected by the edge sensor, the first disk is actuated into rolling contact with the still rotating drive shaft, and the process proceeds as above, with the disks sequentially cascading, each into the opposite state, and thus closing the connected column valves. The trailing edge actuation need not wait until after the leading edge action has cascaded to the last column; for short sheets, the trailing edge action may follow the leading edge action by any interval, so that a set of a selected number of open columns essentially proceeds down the platen.

Figure 11:
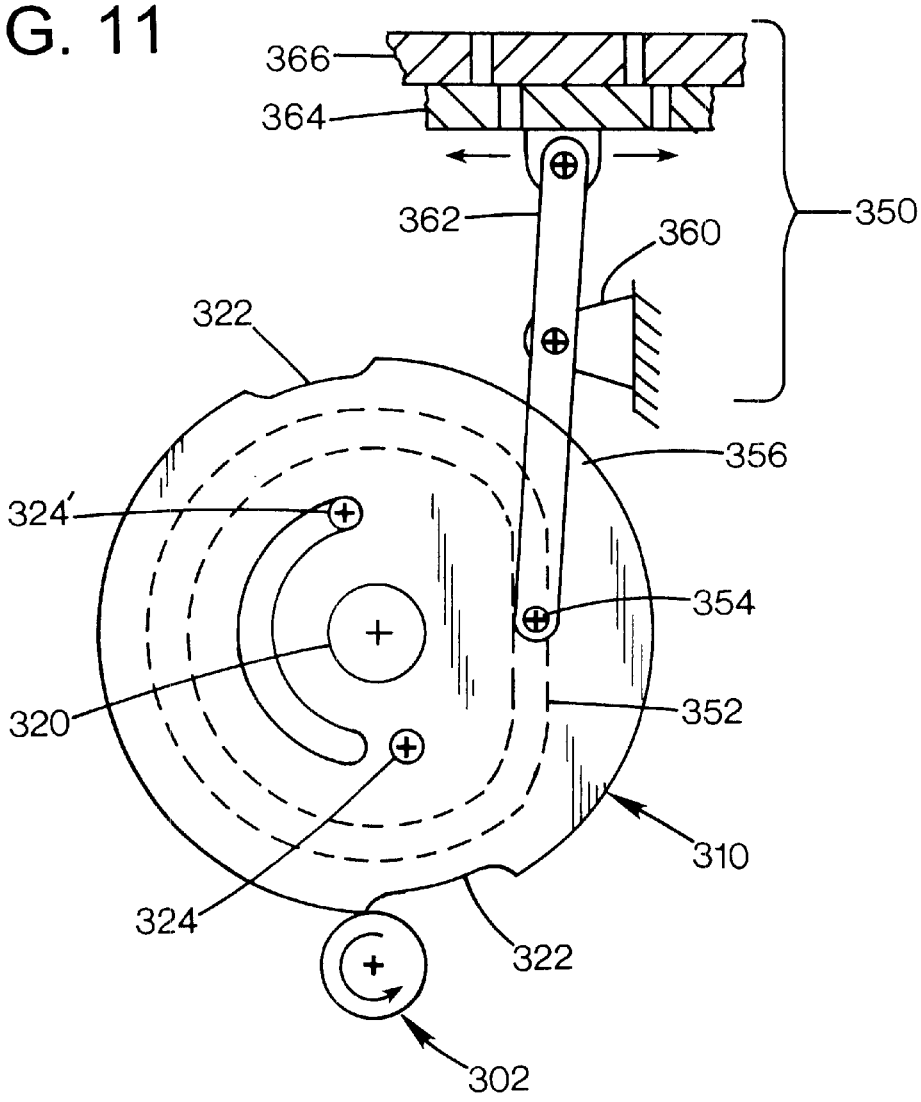
FIG. 11 is an axial view of the embodiment of FIG. 10.

FIG. 11 shows a simplified possible linkage between a typical rotating cam disk 310 and a platen valve device 350. The disk includes a channel 352 defined in the opposed surface, and which receives a pin 354 on one end of a rocker arm 356. The arm is supported at an intermediate pivot point by a fixed support 360, and an opposite end 362 of the arm connects to a perforated slider 364 that underlies a perforated plate 366. The slider is associated with an entire column on the platen. The channel 352 is configured so that the arm pin is at a shorter radius from the shaft 320 when the disk is in the first stable state shown, than when the disk is rotated to the other stable position. Accordingly, the perforations in the slider are offset from those in the plate when the disk is in the first stable position to block airflow, and the perforations align to permit airflow when the disk is in the other stable position. In an embodiment that allows for the mechanism to control active width in addition to sequencing the valves for leading and trailing edges, Each wheel may have more then two divots, and therefore more than two stable positions. The extra divots each may correspond to a different intermediate valve position for a selected sheet width (column height). This is believed to require more than one disk per column.

While the above is discussed in terms of preferred and alternative embodiments, the invention is not intended to be so limited.

What is claimed is:

1. A printer with a media transport comprising:

a rigid, air-transmissive platen;

a movable air-transmissive flexible web overlaying the platen and movable along a feed axis;

a suction device in communication with the platen to draw air through the web and through the platen such that a sheet of media carried on the web is biased toward the platen;

a manifold underlying the platen and defining a plurality of separate chambers open to the platen, wherein the suction device is connected to each of the chambers; and control means operable to selectably prevent communication between the suction device and at least some of the chambers;

wherein the chambers are arranged in rows and columns, the rows parallel to the feed axis, and the columns perpendicular to the feed axis and overlapping the rows.

2. The printer of claim 1 wherein the platen includes a multitude of air passages for each chamber.

3. The printer of claim 1 wherein at least some of the chambers define a single passage communicating with the suction device.

4. The printer of claim 1 wherein, for at least some of the chambers, an associated portion of the platen provides a greater air flow resistance than an air flow path between the chamber and the suction device.

5. The printer of claim 1 wherein the columns are oriented side-by-side, each perpendicular to the feed axis defined by motion of the web.

6. The printer of claim 1 wherein each column includes a symmetrical arrangement of chambers.

7. The printer of claim 1 wherein each column includes a central chamber, and at least an outlying chamber at each end of the central chamber.

8. The printer of claim 7 wherein the central chamber is longer than each of the outlying chambers.

9. The printer of claim 1 wherein the control means includes a check valve associated with each of the chambers, each check valve having an open position and a closed position with respect to the flow of air.

10. The printer of claim 9 wherein each check valve includes a ball that normally obstructs flow by resting in a valve seat aperture when in the closed position, and permits air flow when in a dislodged position.

11. A printer with a media transport comprising:

a rigid, air-transmissive platen;

a movable air-transmissive flexible web overlaying the platen and movable along a feed axis;

a suction device in communication with the platen to draw air through the web and through the platen such that a sheet of media carried on the web is biased toward the platen;

a manifold underlying the platen and defining a plurality of separate chambers open to the platen, wherein the suction device is connected to each of the chambers;

control means operable to selectably prevent communication between the suction device and at least some of the chambers;

wherein the chambers are arranged side-by side and perpendicular to the feed axis defined by motion of the web, and each chamber includes a central chamber, and at least an outlying chamber at each end of the central chamber; and wherein the outlying chambers are arranged in corresponding pairs, and wherein the control means is operable to simultaneously control airflow to each chamber of a pair.

12. The printer of claim 11 wherein the control means includes a sliding shutter for each chamber.

13. The printer of claim 12 wherein each shutter defines at least one opening for each chamber, such that sliding the shutter to an open position aligns the opening with a passage from the chamber to the suction device admits air flow, and sliding the shutter to a closed position obscures the opening.

14. The printer of claim 13 wherein the shutter is movable through a range of positions from a fully open position in which all chambers admit air flow, to a fully closed position in which no chambers admit air flow.

15. The printer of claim 14 wherein the shutter includes at least one intermediate position in which less than all chambers admit air flow.

16. The printer of claim 13 wherein the shutter is movable through a range of positions from a fully open position in which all chambers admit air flow, a first intermediate position in which all chambers but the most remote end chambers admit air flow, a second intermediate position in which only a central chamber admits air flow, and a fully closed position in which no chambers admit air flow.

17. The printer of claim 16 including a further intermediate position between the first and second position in which only the central chamber and a pair of adjacent chambers, each between the central chamber and a respective remote end chamber, admit air flow.

18. The printer of claim 13 wherein the shutter is movable along a slide axis parallel to the chamber, and wherein the openings defined in the shutter are of different lengths along the slide axis, such that a range of positions over which each shutter is open correspond to the length of the opening.

19. A printer with a media transport comprising:

a rigid, air-transmissive platen;

a movable air-transmissive flexible web overlaying the platen and movable along a feed axis;

a suction device in communication with the platen to draw air through the web and through the platen such that a sheet of media carried on the web is biased toward the platen;

a manifold underlying the platen and defining a plurality of separate chambers open to the platen, wherein the suction device is connected to each of the chambers;

control means operable to selectably prevent communication between the suction device and at least some of the chambers; and wherein the manifold chambers are arranged in a matrix of rows parallel to the feed axis and columns perpendicular to the feed axis, and wherein the control means includes an elongated valve element associated with each row and an elongated valve element associated with each column, and wherein each valve element is movable between a closed position in which flow from the chamber is blocked, and an open position in which flow from the chamber is unblocked.

20. The printer of claim 19 wherein the valves are arranged in rows, and each row has an associated actuator assembly having a plurality of actuator portions, each associated with a ball and operable to dislodge the ball when the actuator is in a selected position.

21. The printer of claim 20 wherein each actuator assembly is journaled for rotation.

22. The printer of claim 20 wherein the actuator portions are arranged to dislodge different sets of balls when in different rotational positions.

23. The printer of claim 22 wherein the actuator assembly is rotatable through a range of angles from a fully open position in which all the balls are dislodged, through at least an intermediate position in which at least one ball on each end of the row is closed, and the remaining balls are dislodged, to a closed position in which all of the balls are seated.

24. The printer of claim 23 wherein the actuator portions are arranged symmetrically, such that the same number of balls are closed at each end of the row for each position of the actuator assembly.

25. The printer of claim 23 wherein the actuator portions are arranged to sequentially close valves from each end of the row as the actuator rotates through its range of motion.

26. The printer of claim 23 wherein a central set of actuator portions are arranged similarly to operate the corresponding ball valves in concert.

27. The printer of claim 19 wherein the valves are arranged in rows, and each row has an associated actuator assembly having a plurality of actuator portions, each associated with a valve and operable to open the valve when the actuator is in a selected position.

28. The printer of claim 27 wherein the actuator portions are arranged to actuate different sets of valves when in different rotational positions.

29. The printer of claim 28 wherein the actuator assembly is rotatable through a range of angles from a fully open position in which all the valves are open, through at least an intermediate position in which at least one valve on each end of the row is closed and the remaining valves open, to a closed position in which all of the valves are closed.

30. The printer of claim 29 wherein the actuator portions are arranged symmetrically, such that the same number of balls are closed at each end of the row for each position of the actuator assembly.

31. The printer of claim 30 wherein the actuator portions are arranged to sequentially close valves from each end of the row as the actuator rotates through its range of motion.

32. The printer of claim 31 wherein a central set of actuator portions are arranged similarly to operate the corresponding valves in concert.

33. The printer of claim 19 wherein the elongated valve element associated with each row includes a plurality of transverse bores, the elongated valve element associated with each column includes a corresponding plurality of bores each having an outlet aperture communicating with the suction device and an inlet aperture communicating with a respective manifold chamber, the row valve element bores being registered with the column valve element bores to permit air flow through the apertures when the row and column valve elements are in an orientation to align the bores, and to prevent air flow when the row and column valve elements are in a different orientation.

34. The printer of claim 33 wherein each elongated valve element associated with each row comprises a shaft and wherein the apertures of the shaft communicate with respective chambers of a single row, such that the width of the platen through which air flows may be selected to compensate for different media widths carried by the web.

35. The printer of claim 33 wherein each elongated valve element associated with each column comprises a shaft and wherein the apertures of the shaft communicate with respective chambers of a single column, such that manifold chambers that a leading edge of a media sheet carried by the web have not yet reached, and manifold chmabers that a trailing edge of the sheet have passed may be prevented from transmitting air flow to the suction device.

36. The printer of claim 33 wherein the elongated valve elements associated with the matrix of columns comprises a first set of shafts and the elongated valve elements associated with the matrix of rows comprises a second set of shafts, the first set of shafts each communicating with a respective column, and the second set of shafts each communicating with a respective row.

37. The printer of claim 36 wherein the control means defines a plurality of passages, wherein each passage is defined by a row valve element bore and a corresponding column valve element bore, each passage communicating between a respective chamber and the suction device, and wherein each passage passes through a shaft of the first set and a shaft of the second set in series, such that both shafts through which each passage passes must be in the open position for air flow through the passage.

38. The printer of claim 19 wherein the valve elements are cylindrical shafts received in a common valve body.

39. The printer of claim 19 wherein the valve elements are arranged in a perpendicularly intersecting grid.

40. The printer of claim 19 wherein the valve elements associated with the chamber rows are positioned in a first common plane, and the valve elements associated with the chamber columns are positioned in an offset second common plane parallel to the first plane.

41. The printer of claim 19 wherein at least some of the valve elements associated with the rows are interconnected in pairs, such that the elements of each pair operate in concert.

42. The printer of claim 19 wherein the valve elements associated with the columns are operably connected to a sequencer operable to sequentially actuate the column valve elements.

43. The printer of claim 42 wherein the sequencer is operable to rotate a valve element by one quarter turn as it passes the valve element.

44. The printer of claim 19 wherein the web is operable to carry a media sheet in a feed direction along a feed axis and wherein the control means includes a sequencer operable to sequentially transfer an airflow state of each column to the next column in the feed direction.

45. The printer of claim 44 wherein the sequencer is operably connected to the web, such that the transfer of airflow states proceeds at a velocity equal to a web velocity.

46. The printer of claim 44 wherein the control means includes an actuator associated with a first one of the columns upstream with respect to the feed direction.

47. The printer of claim 46 including a controller operable to determine a media edge position relative to the belt, and operably connected to the actuator to set the actuator based on the edge position.

48. The printer of claim 44 wherein the sequencer includes an airflow control actuator associated with each of the columns, a common driver operably connected to each of the actuators, and an interconnection with each adjacent actuator.

49. The printer of claim 48 wherein each actuator includes an element having at least two states in which the element is disconnected from the driver, and wherein the interconnection to an adjacent actuator is operable to move the actuator to a position in which the actuator is connected to the driver.

50. The printer of claim 48 wherein each actuator is a wheel having a periphery contacting the driver, the periphery of each wheel defining at least two cut outs.

51. The printer of claim 19 wherein the control means is operably connected to the web, and operable to selectably prevent communication at locations based on the position of the web.

* * * * *

UNITED STATES PATENT AND TRADEMARK OFFICE

CERTIFICATE OF CORRECTION

PATENT NO. : 6,543,948 B2
DATED : April 8, 2003
INVENTOR(S) : James O. Beehler et al.

It is certified that error appears in the above-identified patent and that said Letters Patent is hereby corrected as shown below:

Column 13,
Line 15, delete "chmabers" and insert therefor -- chambers --

Signed and Sealed this

Second Day of August, 2005

JON W. DUDAS
*Director of the United States Patent and Trademark Office*